United States Patent [19]

Hübsch et al.

[11] 4,353,304

[45] Oct. 12, 1982

[54] PROPELLANT CHARGE IGNITER

[75] Inventors: Günter Hübsch, Kalchreuth; Rudolf Stahlmann, Fürth, both of Fed. Rep. of Germany

[73] Assignee: Dynamit Nobel Aktiengesellschaft, Troisdorf, Fed. Rep. of Germany

[21] Appl. No.: 60,618

[22] Filed: Jul. 25, 1979

[30] Foreign Application Priority Data

Jul. 27, 1978 [DE] Fed. Rep. of Germany ..... 2832879

[51] Int. Cl.[3] ..... F42B 5/26; F42B 9/26

[52] U.S. Cl. ..... 102/470; 102/202.14; 102/204

[58] Field of Search ..... 102/44, 45, 46, 38 R, 102/203, 209; 102/469, 470, 471, 472, 430, 202.5–202.14

[56] References Cited

U.S. PATENT DOCUMENTS

| | | | |
|---|---|---|---|
| 606,440 | 6/1898 | Bennett | 102/45 |
| 740,790 | 10/1903 | Young | 102/45 |
| 2,681,701 | 6/1954 | Schlumberger | 102/46 X |
| 3,195,463 | 7/1965 | Foote et al. | 102/204 |
| 4,020,763 | 3/1977 | Iruretagoyena | 102/44 |
| 4,027,592 | 6/1977 | Hubsch et al. | 102/45 |

FOREIGN PATENT DOCUMENTS

| | | | |
|---|---|---|---|
| 2364272 | 6/1975 | Fed. Rep. of Germany | 102/46 |
| 1168684 | 10/1969 | United Kingdom | 102/46 |

*Primary Examiner*—Harold J. Tudor

*Attorney, Agent, or Firm*—Antonelli, Terry & Wands

[57] ABSTRACT

A propellant charge igniter includes a casing that contains a central contact member, an igniter element, a sealing element associated with the igniter element, and a powder charge. The sealing element has on a side facing the powder charge, an annular collar in sealing contact with an inner wall of the casing.

12 Claims, 9 Drawing Figures

PROPELLANT CHARGE IGNITER

Figure 1A:
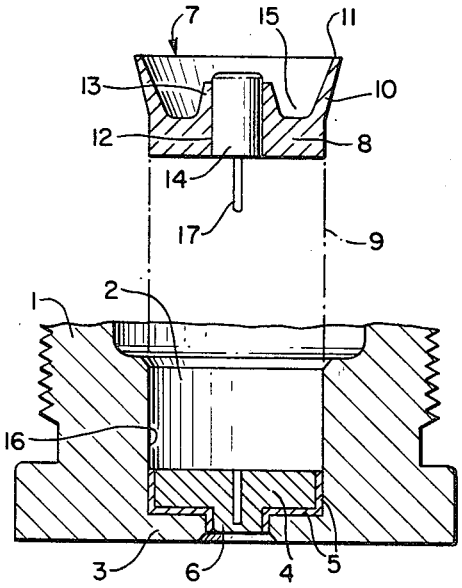

The invention relates to a propellant charge igniter having a casing in which a central contact member, an igniter element, a powder charge and a sealing element are inserted in succession.

Propellant charge igniters can be triggered electrically and/or mechanically, i.e. by impact. For guns in tanks or ships, for example, electrical propellant charge igniters are known which meet the requirements for gas pressure resistance of their bases up to a gas pressure of about 5,000 bar. The casings of these propellant charge igniters are produced, for reasons of manufacturing technology, from metals which can be readily subjected to metal-cutting and/or flanging, for example brass alloys with lead additives. The same holds true for the central member of the electrical propellant charge igniter, fashioned as an electrical central or middle contact and being inserted, electrically insulated by the interposition of corresponding insulating materials, in the casing of the propellant charge igniter so that it is accessible from the outside to be connected to one of the electrodes of the primer device of the gun. The casing furthermore accommodates the electrical igniter element as well as the powder charge to be ignited thereby, i.e. the so-called "booster charge". The igniter element is electrically conductively connected with its one pole to the central contact member and with its other pole to the casing. The igniter element can be joined to the casing by a threaded connection and/or by flanging and/or by an annular seal.

The propellant charge igniters which can be triggered mechanically exhibit, as the central contact member, an externally accessible striker element which, or a part of which, can be displaced forwardly under the effect of the firing pin of the weapon in the casing of the propellant charge igniter, triggering the mechanical igniter element disposed in front of this central member. Here again, the igniter element can be affixed in the casing by threaded connection, sealing, flanging, or the like.

By the gas pressure occurring during firing, the metallic materials of these propellant charge igniters are generally stressed beyond their yield points, so that plastic deformations occur. During this process, the casing of the propellant charge igniter is likewise widened, i.e. enlarged in its inner diameter, whereby a more or less large radial play is produced between the casing and the igniter element inserted therein. Since the casing of the propellant charge igniter, on account of the outwardly accessible central member, is open at its rear end face, i.e. at the bottom, there is, however, the danger that hot powder gases escape toward the rear via the gap between the casing and the igniter element and the bottom opening. This can result not only in damage or even destruction of the firing mechanisms of the respective firearm system, but also, for example in case of weapon systems with closed inner spaces, such as, for example, in combat tanks or gun turrets of ships, there exists mortal danger for the operating personnel due to the hot gases which flow at high velocity into the inner spaces.

To obtain, considering the radial widening effects of the casing, propellant charge igniters which, in spite of this, are gastight toward the rear, the sealing is effected by means of abutting surfaces extending in radial planes, for example the underside of the central contact member and the counter surface of the casing facing this central contact member as well as the insulating disk of the electrical propellant charge igniter disposed between these two surfaces. A prerequisite for the effectiveness of such a gas pressure seal is that there are perfectly planar-parallel contact surfaces without radial indentations, flaws, or the like. Also inhomogeneities in the insulating material, for example, must be avoided. In this way, it is possible to attain a gas pressure strength of up to about 7,500 bar, wherein a housing with an original inner diameter of about 20 mm. is widened to about 21 mm.

However, one disadvantage herein is the very high expense for the extremely precise manufacture of the individual parts of the propellant charge igniter and for their further processing.

The invention is based on the objective of providing a propellant charge igniter with high gas pressure resistance which can be reliably manufactured at a comparatively low expenditure. In particular, propellant charge igniters are involved herein which can be triggered electrically.

This objective has been attained according to the invention by providing a sealing element associated with the igniter element of the charge igniter, the sealing element having on a side facing the powder charge an annular collar in sealing contact with an inner wall of the casing. The sealing element of this invention is manufactured preferably separately from the igniter element, but it can also be produced integrally therewith, i.e. with the igniter element casing. The separate sealing element, preferably made of metal is axially supported toward the rear under the pressure of the powder gases within the casing of the propellant charge igniter. In case of an electrical propellant charge igniter, this supporting action takes place preferably by way of the central electrode, there being provided an appropriate electrical insulation between the sealing element and the central electrode, if the igniter element is connected via the sealing element electrically conductively with the casing of the propellant charge igniter. However, the sealing element can also be supported toward the rear via the igniter element, the igniter element, in turn, resting on the central electrode of the igniter element, and the central electrode being supported axially toward the rear on the bottom of the propellant charge igniter casing. In this connection, the igniter element can be electrically conductively connected directly to the casing of the propellant charge igniter by way of the lateral wall of this igniter element, so that the sealing element can be made of an electrically nonconductive material.

Correspondingly, a support of the sealing element toward the rear must also be provided in a propellant charge igniter that can be triggered by percussion, so that here again the sealing element can withstand the pressure of the powder gases effective thereon in the axial direction. Insofar as this support is effective at the central member, care must be taken that the part of the central member which can be driven forward under the impact toward the igniter element is not unduly impeded in its movement.

The external annular collar of the preferably metallic sealing element acts as an obturation or closure member which, with increasing gas pressure, is ever more firmly pressed against the casing wall of the propellant charge igniter in the radial direction, so that the sealing effect is increased by the gas pressure and, in case of a plastic widening of the casing, the obturation member follows the casing, i.e. the contact of the sealing collar against the inner wall of the casing and thus the force-derived connection between the sealing element and the casing is ensured in any event. The collar is preferably fashioned with a wall thickness decreasing toward its free edge, i.e. it is constructed as a closure lip. If the sealing element is arranged axially in front of the igniter element, the sealing element is provided with a preferably central axial opening making it possible for the ignition jet emanating from the igniter element to safely pass through to the powder charge. In contrast, thereto, if the sealing element surrounds the igniter element, i.e. if both are arranged, so to speak, in radial juxtaposition, then it can be advantageous also to provide the sealing element with an identical inner collar or obturation element which sealingly contacts the casing of the igniter element.

With the use of the sealing element of this invention, the propellant charge igniter can also be utilized for very high gas pressures. In this connection, the casing of the propellant charge igniter can still be made of a material which is easily cut and/or flanged and thus can still be manufactured relatively economically. The central contact member, in contrast thereto, is preferably made of a material of higher strength, to avoid shearing off if the central member and/or the casing bottom of the propellant charge igniter can be sufficiently supported toward the rear only along part of their surface on the breechblock of the firearm. This is the case, for example, in electrical triggering in the zone of the contact pin extended through the breechblock, which pin forms an only inadequate abutment for the propellant charge igniter. This zone of reduced support should be maintained as small as still permitted by the respective weapon system.

The construction of this invention has the consequence in an electrical propellant charge igniter that the sealing function need no longer be performed by the insulating materials employed, but rather is accomplished by the external obturation lip and optionally also an internal obturation lip of the sealing element. The gas pressure seal for the insulating elements utilized is thus merely of subordinate importance any more, if at all. Also the mutually facing radial surfaces of the central contact member and of the casing bottom of the propellant charge igniter need no longer be manufactured with respect to their planar-parallel feature, surface quality, etc. with the expenditures, i.e. narrow tolerances, required without the sealing element of this invention.

To obtain the sealing contact of the collar of the sealing element of this invention against the inner wall of the casing of the propellant charge igniter, the collar can—viewed prior to its installation into the casing—be formed with an external configuration which preferably flares conically toward the free rim or edge, this configuration being dimensioned to be that much larger than the cylindrical casing recess that the collar, of cylindrical shape on the outside after the sealing element has been pressed into this recess, is urged with the necessary radial contact force against the inner wall of the casing. Analogously, in case of an optionally additional, inner collar, the inner collar—prior to installation of the igniter element—can taper preferably conically toward its free rim or lip so that after urging the igniter element into the recess of the sealing element surrounded by the inner collar, this inner collar is pressed, with a corresponding cylindrical widening, against the outer wall of the igniter element. The outer collar of the sealing element is under compressive stress, while its optional, inner collar is under tensile stress.

In a suitable development of the invention, a construction has been provided to attain an additional, shape-mating fixation of the sealing element also in the axial direction and thus to obtain a higher shock resistance against axial impact stresses. The collar of the sealing element, oriented conically prior to installation, locks with its free rim into this annular indentation, in that it exhibits corresponding resilient rebound in the radially outward direction. This construction has the further advantage that, in place of a sealing element with an initially outwardly oriented collar, it is also possible to use a sealing element having a cylindrical collar which can be manufactured at lower expense. This sealing element is preferably inserted in the casing recess with a sliding fit and then the collar is widened, especially in the zone of its free rim, by means of an appropriate tool in the radially outward direction and pressed into the indentation so that, on the one hand, there is a secure shape-mating connection in the axial direction and, on the other hand, the collar is pressed sufficiently firmly and tightly against the inner wall of the casing. Especially in the latter case, it proves to be advantageous to firmly flange an annular ridge projection or strip of the casing, arranged above the indentation, over the rim of the collar to enhance the contact force.

An especially advantageous arrangement of the propellant charge igniter of this invention with a sealing element for very high gas pressures is obtained by the provision of a hold down member within the igniter casing. The holddown member is preferably threaded into the casing of the propellant charge igniter, but it could also be held in the casing in some other suitable way, for example by being forced into it, so that the collar of the sealing element is pressed to the required extent against the inner wall of the housing. The mutually contacting surfaces of the sealing element and the holddown or pressure contact member can, for example, be slightly curved spherically. The contact pressure of the obturation lip of the sealing element against the inner wall of the casing can be predetermined in correspondence with the respective requirements by the inclination of these surfaces in the contact zone and by the force exerted by the holddown element on the obturation lip. The holddown member has a continuous, central axial opening, the inside cross section of which is at least so large that the ignition jet of the igniter element can pass therethrough and ignite the powder charge arranged thereafter flawlessly. Preferably, the holddown member is fashioned as a tubular body wherein a part of the powder charge has already been provided. The wall thickness of the tubular holddown member is determined in dependence on its material strength in such a way that the holddown member can exert the required radial contact pressure on the sealing element.

The contact surfaces of the holddown member and the sealing element are fashioned preferably to be conical; in this connection, with respect to the manufacturing tolerances which are not readily avoidable in mass production, it proves to be advantageous to choose an inclination of the conical surfaces of an extension of the holddown member that are slightly smaller than the inclination of the conical surfaces of the collar i.e. by about 1°–3°.

The sealing element is preferably intended to serve at the same time as the receiving body for the igniter element. The igniter element, in this connection, especially in case of electrical triggering, is inserted with a press-fit in the recess or bore emanating from the rearward end face of the sealing element, to establish a perfect electrical connection by way of the sealing element between the jacket of the igniter element and the casing of the propellant charge igniter. Here again, the sealing element is provided with at least one ignition aperture associated with the igniter element for the passage of the ignition jet. To keep the axial height of the sealing element at a minimum, on the one hand, but yet to obtain an external, annular collar of a sufficient height with the required obturation behavior, on the other hand, a construction of the sealing element having an annular recess proves to be advantageous. Preferably, the radial width of the recess is enlarged in this embodiment toward the free rim or lip of the collar, so that, in particular, the wall thickness of the collar decreases toward the rim.

Figure 2A:
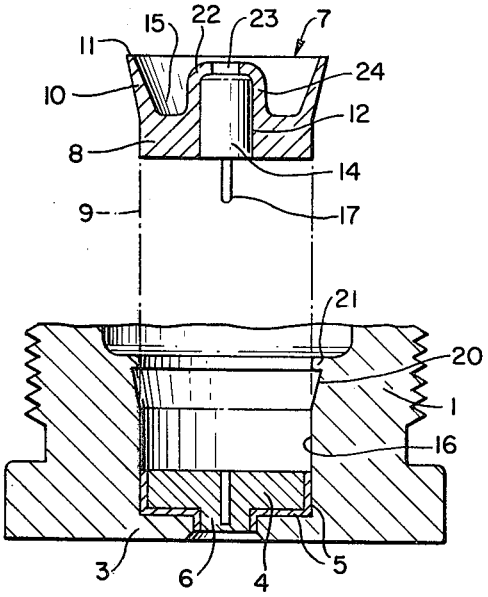
Figure 1B:
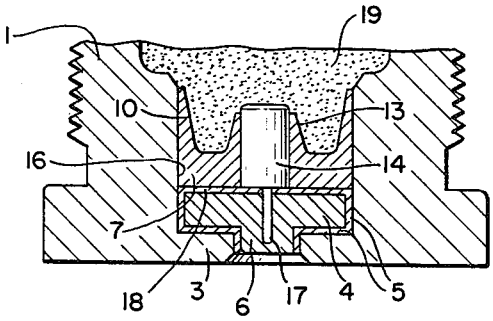
Figure 2B:
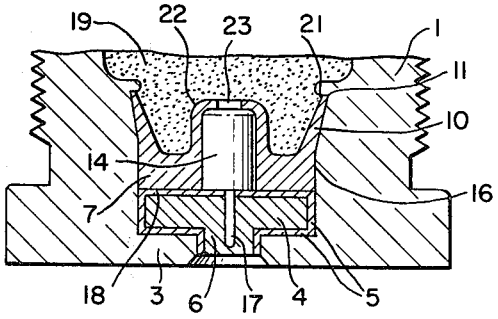
Figure 3A:
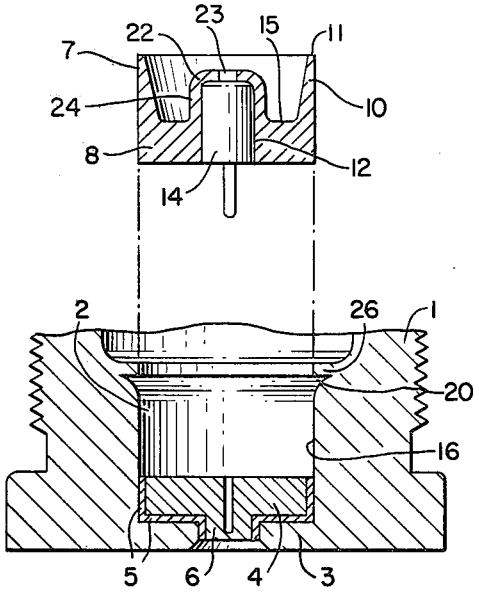
Figure 3B:
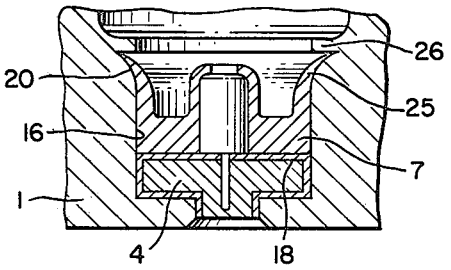
Figure 3C:
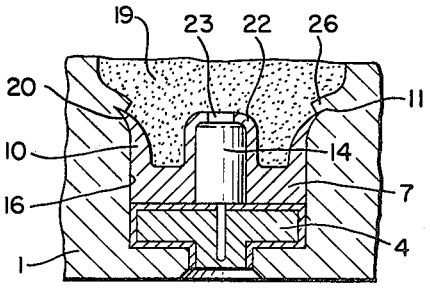
Figure 4:
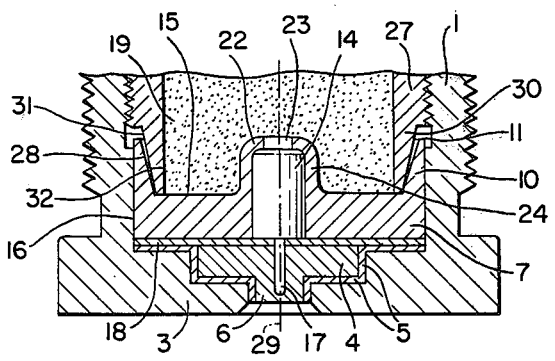
Figure 5:
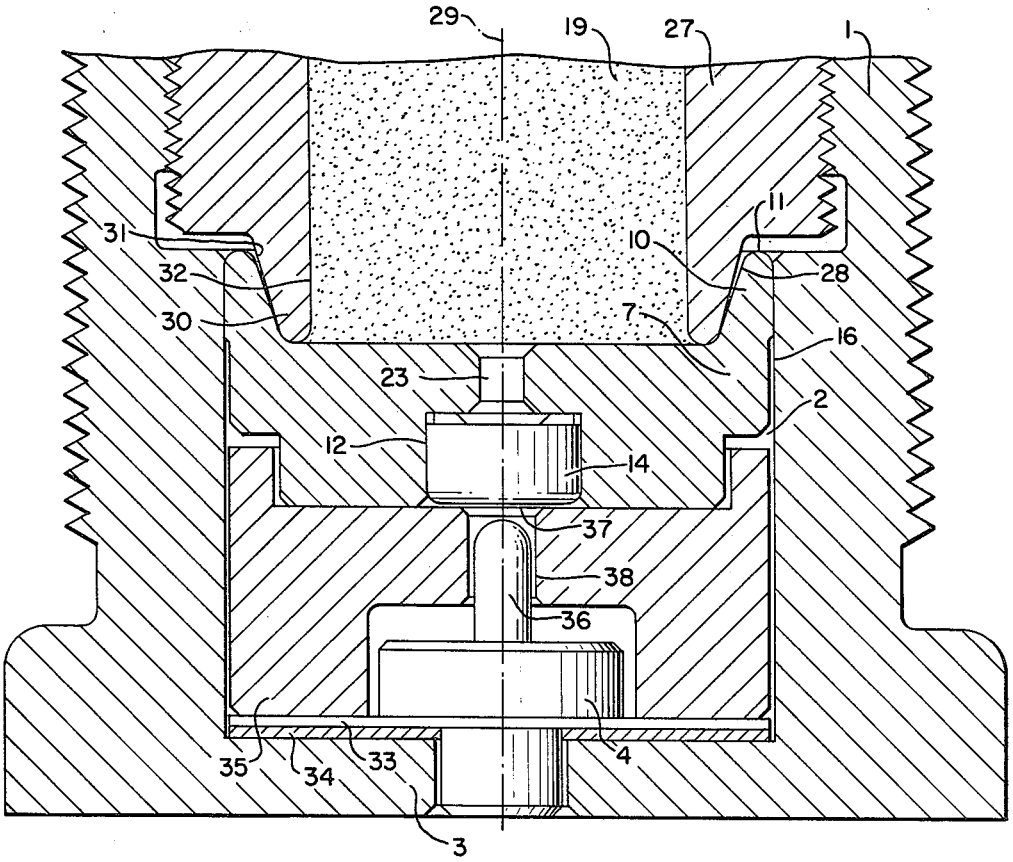

The invention is shown in the embodiments illustrated in the drawings and will be explained in greater detail in the following description with reference thereto. The figures, respectively, are longitudinal sectional views wherein:

FIGS. 1*a* and 1*b* shows the rear end of an electrical propellant charge igniter with a sealing element before and after installation;

FIGS. 2*a* and 2*b* show a modification of the igniter thereof;

FIGS. 3*a* through 3*c* show a further modification of the igniter;

FIG. 4 shows a propellant charge igniter with a sealing element and a holddown member; and FIG. 5 shows a mechanically activatable propellant charge igniter with a sealing element.

FIG. 1*a* shows the rear end of a tubular-shaped casing or housing of a propellant charge igniter with a central, cylindrical bore 2 in which is inserted the central contact member 4, here an electrical central contact, which central member is supported axially toward the rear of the igniter on the bottom 3 of the casing 1. The central contact member 4 is electrically insulated with respect to the casing 1 by means of the insulations 5 made of a thermoplastic synthetic resin. The central extension 6 of the central contact member 4, accessible from the outside, can be electrically conductively connected to the contact pin of the gun, not shown.

The sealing element 7 has a cylindrical base member or portion 8, the outer diameter of which—as indicated by the dashed lines 9—corresponds to the inner diameter of the housing bore 2 within the casing 1. In the forward direction, the external annular collar 10 extends from the base member 8, the wall thickness of this collar decreasing toward its free rim 11 and this collar conically flaring toward the rim 11. In the forward direction, the central bore 12 of the base member 8 is followed by the inner annular collar 13; this inner collar is in sealing contact with the electrical igniter element 14 shown in an elevational view; this igniter element is urged with a press-fit into the bore 12. The high-pressure resistant sealing element 7, therefore, is in this embodiment fashioned simultaneously as a mounting or supporting means for the igniter element. The annular recess 15 the inside diameter of which flares in the forward direction, starting with the base member 8, is arranged around the igniter element 14 and/or around its associated collar 13.

In FIG. 1*b*, the sealing element 7 is shown in place, i.e. the mounted condition, wherein its outer collar 10 contacts, in the manner of an obturation or closure lip, sealingly the inner wall 16 of the bore 2 of casing 1. This pressure-derived and thus gastight contact function is obtained by providing—as shown in FIG. 1*a*—that prior to assembly the outer dimensions of the conical collar 10 are larger than the inside cross section of the bore 2, so that when the sealing element 7 is urged with a press-fit into the bore 2, the collar 10 is radially compressed so that it contacts the inner wall 16 under compressive stress. By this measure, it is ensured that the collar 10 follows the radial widening of casing 1, which takes place during firing, i.e. that the collar continues to sealingly contact the inner wall 16 of the casing.

The igniter element 14 is electrically conductively connected with the central contact member 4 by way of its central electrode pin 17. The sealing element 7 is electrically insulated from the central contact member by the interposed disk 18 of insulating material. On the side of the sealing element 7 facing away from the central contact member 4, the powder charge is arranged, which is a booster charge to be ignited by the igniter element 14 and which also fills out the annular recess 15 of the sealing element 7.

The propellant charge igniter shown in FIGS. 2*a* and 2*b* differs from that of FIGS. 1*a* and 1*b* by the indentation or groove 20 extending in the shape of a channel continuously in the wall 16 of the bore 2, this indentation being arranged so that the sealing element 7, when urged into the bore 2, locks in a radially outward orientation with its free rim 11 of the conically oriented collar 10 into this machined-in channel 20. For the suitable compensation for manufacturing tolerances, a continous strip 21 above the channel-like cut 20 is additionally pressed downwardly against the rim 11 and is plastically deformed during this step so that the sealing element 7 is reliably fixed in position in the axial direction. This construction is utilized if high axial impact stresses must be absorbed without functional disturbances. Another difference as compared with the previously illustrated propellant charge igniter resides in the preferred mounting of the igniter element so that it is inserted, preferably with a press-fit, in a bore 12 of the sealing element 7, which bore is closed at the front end 22 except for an ignition opening 23. Thus, the igniter element 14 is surrounded in a gastight fashion by the sealing element 7 and is also reliably fixed in the axial direction. Between the zone 24 of the sealing element 7 surrounding the igniter element 14, and the collar 10 of the sealing element, an annular recess 15 is again provided.

In the propellant charge igniter shown in FIGS. 3*a* through 3*c*, the sealing element 7 has a circular-cylindrical outer shape, i.e. the collar 10 is not oriented outwardly. Here again, however, the wall thickness of the collar 10 decreases toward the free rim 11. The sealing element 7 is inserted with sliding fit in the circular-cylindrical bore 2 of the casing 1 and then pressed with the forward portion 25 of its collar 10 by plastic deformation toward the outside into a channel-like indentation 20 machined into the casing 1. In a further working step, the narrow ridge 26, located above the indentation 20, having, with an inner diameter of the bore 2 of, for example, 20 mm., a radial width of about 0.6–1 mm., is flanged over the rim 11 of the collar 10 in the downward direction. Thereby the lip portion of collar 10, which resiliently rebounds in the elastic zone, is firmly pressed against the wall of the indentation 20.

FIG. 4 shows a propellant charge igniter having a particularly high gas pressure resistance, wherein the sealing action obtainable by means of the sealing element 7 is amplified by a holddown member 27 threaded into the casing 1 of the propellant charge igniter. The collar 10 of the sealing member 7 is fashioned with a conical inner surface 28, the diameter of which increases toward the free rim 11. The angle of inclination of the inner surface 28 with respect to the longitudinal axis 29 of the propellant charge igniter is, for instance, 12°. The holddown member 27 has, on its end facing the sealing element 7, an annular extension or counter cone 30, the outer surface 31 is likewise fashioned to be conical; this outer surface is inclined in the same sense as the inner surface 28, but the angle of inclination with respect to the longitudinal axis 29 is preferably somewhat smaller, i.e. for example 10°. The holddown member 27, fashioned as a screw part, is threaded with its counter cone 30 against the conical inner surface 28 of the collar 10 with such a torque that the collar 10 is pressed in the required manner radially against the inner wall 16 of the casing 1. The torque required for this purpose is dependent on the deformability of the collar 10 and of the counter cone 30. The arrangement is made preferably so that, with an outer diameter of the collar 10 of between about 10 mm. and 30 mm., the inner diameter 32 of the counter cone 30 is reduced by about 0.2–0.4 mm., when the torque is applied which is required for the desired radial contact action. The obturation effect produced by the holddown member 27 is additionally enhanced due to the effect of the gas pressure during firing, i.e. an even higher sealing effect is attained and the gas pressure is flawlessly transmitted via the counter cone 30 and the collar 10 to the outer casing 1. Otherwise, the structure of this electrical propellant charge igniter corresponds to that of FIGS. 2*a* through 3*c*, apart from the fact that here the sealing element 7 has a larger outer diameter than the central contact member 4.

The sealing element 7 is here, as well as in the other instances, made of a material, e.g. a brass or steel alloy, which exhibits sufficient deformability so that during the widening action exerted during firing the material is not stressed beyond its yield point. The central contact member 4, in contrast thereto, is preferably made of a higher-strength material to avoid the danger of shearing off the central part of the member 4, since the supporting action on the breech system of the gun is normally lower in the zone of the extension 6. The sealing element 7 is here manufactured in each case separately from the igniter element 14. However, it is also easily possible, if this should prove to be advantageous in an individual case, to fashion the outer annular collar 10, which effects the seal with respect to the casing 1 of the propellant charge igniter, integrally with the igniter element 14, the latter then being provided with a correspondingly modified casing.

FIG. 5, finally, shows a propellant charge igniter with an igniter element 14 which can be triggered mechanically, i.e. by percussion wherein—just as in FIG. 4—the sealing element 7 with its collar 10 is pressed against the inner wall 16 of the casing by means of the holddown member 27 introduced into the housing 1, preferably by threading. The central contact member 4, shown in an elevational view, which here is a striker element, is clamped, in accordance with DOS [German Unexamined Laid-Open Application] No. 2,504,907, with its tear-off shoulder 33 with interposition of the seal 34 between the bottom 3 of the casing 1 and the counter member 35. In the rearward direction, the sealing member 7, inserted in the bore 2 of casing 1, rests on the counter member 35. Under the force of an impact, the central contact member 4 is driven with its firing pin 36 against the igniter element 14, shown in an elevational view, in the forward direction; the igniter element 14 is inserted in the central bore 12 of the sealing element 7 with press-fit. The ignition jet from this igniter element effects, through the igniter opening 23, the ignition of the powder charge 19. The bottom 37 of the igniter element 14 is fashioned to be so strong that is withstands the pressure of the powder gases effective thereon even in the region of the striker pin passage 38 of the counter member 35, where its rearward support is lessened. Otherwise, the construction corresponds to that of FIG. 4, so that reference is had to the explanations rendered in connection with FIG. 4 regarding the remaining reference numerals.

Another preferred variant can be derived from FIGS. 4 and 5 by modifying the sealing element 7 and the holddown member 27 in such a way that the holddown member extends with its annular extension 30 from the outside over the collar 10 of the sealing element 7, and the inner surface of the extension 30 and the outer surface of the collar 10 are inclined toward each other at least in their mutual contact zone, preferably conically, so that by axial pressure of the holddown member 27 against the sealing element 7, the collar 10 of the latter firmly and sealingly contacts the extension 30 of the holddown member 27, with a slight reduction in the collar diameter. The sealing element 7 here is thus in indirect sealing contact with its annular collar 10 with the inner wall 16 of the casing 1, the holddown member 27 being in direct contact with this inner wall 16 with its extension 30. If the extension 30 is viewed as part of the casing wall, however, one could also speak in this case of a direct, sealing contact against the casing wall. To avoid, in certain cases, an excessive constriction of the collar 10 and to obtain also an additional support and sealing effect toward the inside, the holddown member 27 can be fashioned with an inner supporting ring arranged at such a spacing from the extension 30 that the sealing element 7 with its collar 10 contacts the inner surface of the extension 30 as well as the outer surface of the supporting ring of the holddown member 27.

We claim:

1. A propellant charge igniter having a casing and positioned therein, in succession, a central contact member, an igniter element, and a powder charge, said igniter further comprising a sealing element surrounding the igniter element, said sealing element having, on a side contacting the powder charge, an annular collar in sealing contact with an inner wall of the casing and a holddown member arranged in the casing, said holddown member having an annular extension contacting the inner surface of the collar, the inner surface of the collar and an outer surface of the extension being inclined with respect to each other, at least in their contact zone, whereby axial pressure of the holddown member against the sealing element, the collar can be pressed radially against the inner wall of the casing; said holddown member being provided with a central bore in which the powder charge is retained in contact with said sealing element.

2. A propellant charge igniter according to claim 1, wherein the collar of the sealing element has a free rim that engages into an indentation extending along the entire circumference of the inner wall of the casing.

3. A propellant charge igniter according to claim 2, wherein an annular projection of the casing, delimiting the indentation, is flanged over the free rim of the collar.

4. A propellant charge igniter having a casing and positioned therein, in succession, a central contact member, an igniter element, and a powder charge, said igniter further comprising a sealing element surrounding the igniter element, said sealing element having, on a side contacting the powder charge, an annular collar in sealing contact with an inner wall of the casing and a holddown member arranged in the casing, said holddown member contacting with an annular extension the inner surface of the collar, the inner surface of the collar and the outer surface of the extension being inclined with respect to each other, at least in their contact zone, so that by axial pressure of the holddown member against the sealing element, the collar can be pressed radially against the inner wall of the casing, the inner surface of the collar and the outer surface of the extension being fashioned to be conical surfaces; said holddown member being provided with a central bore in which the powder charge is retained in contact with said sealing element.

5. A propellant charge igniter according to claim 4, wherein the inclination of the conical surface of the extension with respect to the longitudinal axis of the casing is slightly smaller than the inclination of the conical surface of collar.

6. A propellant charge igniter according to claim 4, wherein the inclination of the conical surface of the extension with respect to the longitudinal axis of the casing is slightly smaller by about 1°–3° than the inclination of the conical surface of collar.

7. A propellant charge igniter according to one of claims 1, 2, 3, 4, or 5, wherein the sealing element has a bore emanating from a side facing away from the powder charge for receiving the igniter element; said bore being closed at a front end except for an ignition opening which communicates with said powder charge.

8. A propellant charge igniter according to claim 7, wherein the sealing element has, on a side contacting the powder charge, an annular recess between a zone surrounding the igniter element and the collar.

9. A propellant charge igniter which comprises an outer casing, a central contact member positioned in said casing, an igniter element, a powder charge, a sealing element and a holddown member arranged within the outer casing, said sealing element being arranged around the igniter element and positioned between the powder charge and the central contact member to position the igniter element in communication with the powder charge, said sealing element having, on a side contacting the powder charge, an annular collar with an outer portion thereof in sealing and sliding contact with an inner wall of the outer casing, said annular collar having a wall thickness that decreases towards an outer free rim that is positioned adjacent to the inner wall of the outer casing, and said holddown member having an annular extension contacting an inner surface of the annular collar of said sealing member, the inner surface of the collar and the outer surface of the extension being inclined with respect to each other in a contacting area whereby axial pressure exerted by the holddown member against the sealing element causes the annular collar to be pressed radially against the inner wall of the outer casing; said holddown member being threadably engaged with the outer casing and being provided with a central bore in which the powder charge is retained.

10. A propellant charge igniter according to claim 1 or claim 9, wherein the sealing element is arranged within said inner wall of the outer casing under compressive stress whereby an outer contact surface of the collar is radially pressed against the inner wall of the outer casing.

11. A propellant charge igniter according to claim 9, further comprising a counter member arranged between the central contact member and the sealing element, said counter member clamping a tear-off shoulder of the central contact member to a bottom portion of the outer casing.

12. A propellant charge igniter according to claim 1 or 9, wherein said powder charge is a booster charge for igniting the propellant charge.

* * * * *